US007173178B2

(12) United States Patent
Kobayashi

(10) Patent No.: US 7,173,178 B2
(45) Date of Patent: Feb. 6, 2007

(54) SINGING VOICE SYNTHESIZING METHOD AND APPARATUS, PROGRAM, RECORDING MEDIUM AND ROBOT APPARATUS

(75) Inventor: Kenichiro Kobayashi, Kanagawa (JP)

(73) Assignee: Sony Corporation, Tokyo (JP)

( * ) Notice: Subject to any disclaimer, the term of this patent is extended or adjusted under 35 U.S.C. 154(b) by 395 days.

(21) Appl. No.: 10/799,779

(22) Filed: Mar. 15, 2004

(65) Prior Publication Data

US 2004/0231499 A1 Nov. 25, 2004

(30) Foreign Application Priority Data

Mar. 20, 2003 (JP) ..... 2003-079151

(51) Int. Cl.
*G10H 7/00* (2006.01)

(52) U.S. Cl. ..... 84/645; 704/268

(58) Field of Classification Search ..... 704/268; 84/645

See application file for complete search history.

(56) References Cited

U.S. PATENT DOCUMENTS 4,527,274 A * 7/1985 Gaynor ..... 704/267
5,235,124 A * 8/1993 Okamura et al. ..... 434/307 A
5,642,470 A * 6/1997 Yamamoto et al. ..... 704/270
5,703,311 A * 12/1997 Ohta ..... 84/622
6,304,846 B1 * 10/2001 George et al. ..... 704/270
6,424,944 B1 * 7/2002 Hikawa ..... 704/260

* cited by examiner

*Primary Examiner*—Jeffrey W Donels
(74) *Attorney, Agent, or Firm*—Oblon, Spivak, McClelland, Maier & Neustadt, P.C.

(57) ABSTRACT

A singing voice synthesizing method and a singing voice synthesizing apparatus in which the singing voice is synthesized using performance data such as MIDI data. The performance data entered is analyzed as the musical information of the sound pitch, sound duration and the lyric (S2, S3). From the analyzed music information, the lyric is accorded to a string of sounds to form singing voice data (S5, S6). The speech waveform of the singing voice is formulated from the singing voice data (S7, S8). The waveform of the music sound is formulated from the input performance data (S14). The portion of the performance data used for the singing voice is desirably not used in reproducing the music sound, or lowered in the reproducing sound volume. A program, a recording medium and a robot apparatus, in which the singing voice is synthesized from performance data, are also disclosed.

13 Claims, 8 Drawing Sheets

| Track | Channel | Time | Type | Pitch | Duration | Velocity | Duration | Control type |
|---|---|---|---|---|---|---|---|---|
| | | | ⋮ | | | | | |
| 1 | 1 | 5:03:480 | control | – | – | – | – | Vibrato (depth 64, width 64, lag 50) |
| 1 | 1 | 5:03:480 | note | G4 | 199 | 100 | あ | |
| 1 | 1 | 5:04:000 | note | F#4 | 439 | 108 | る | |
| 1 | 1 | 5:04:480 | note | G4 | 199 | 100 | う | |
| 1 | 1 | 6:01:000 | note | E4 | 199 | 90 | ひ | |
| 2 | 1 | 4:01:480 | control | – | – | – | – | Expression (110) |
| 2 | 1 | 4:01:480 | control | – | – | – | – | Vibrato (depth 64, width 64, lag 50) |
| 2 | 1 | 6:01:480 | note | G3 | 199 | 100 | あ | |
| 2 | 1 | 6:02:000 | note | F#3 | 439 | 108 | る | |
| 2 | 1 | 6:02:480 | note | G3 | 199 | 100 | う | |
| 2 | 1 | 6:03:000 | note | E3 | 199 | 90 | ひ | |
| | | | ⋮ | | | | | |

FIG.2

| | |
|---|---|
| ¥song¥ | ← beginning of singing voice data |
| ¥PP,T10673075¥ | ← pause of 10673075 μsec |
| ¥tdyna 110 649075¥ | ← entire velocity during 10673075 μsec from leading end |
| ¥fine-100¥ | ← fine pitch adjustment (same as fine tune of MIDI) |
| ¥vibrato NRPN_dep=64¥ | ← vibrato |
| ¥vibrato NRPN_del=50¥ | |
| ¥vibrato NRPN_rat=64¥ | |
| ¥dyna 100¥ | ← relative strength from sound to sound |
| ¥G4,T288461¥あ | ← G4 pitch sound with duration of 288461 μsec, lyric being 'あ' |
| ¥dyna 108¥ | |
| ¥Gb4,T288462¥る | |
| ¥dyna 100¥ | |
| ¥G4,T288461¥う | |
| ¥dyna 90¥ | |
| ¥E4,T219592¥ひ | |
| ¥PP,T1222716¥ | |
| ¥dyna 100¥ | |
| ¥E4,T144231¥も | |
| ¥dyna 98¥ | |
| ¥E4,T144230¥り | |
| ⋮ | |

FIG.3

SINGING VOICE SYNTHESIZING METHOD AND APPARATUS, PROGRAM, RECORDING MEDIUM AND ROBOT APPARATUS

BACKGROUND OF THE INVENTION

1. Field of the Invention

This invention relates to a singing voice synthesizing method, a singing voice synthesizing apparatus, a program, a recording medium and a robot apparatus, in which the singing voice is synthesized from performance data.

This application claims the priority of the Japanese Patent Application No. 2003-079151 filed on Mar. 20, 2003, the entirety of which is incorporated by reference herein.

2. Description of Related Art

The technique for synthesizing the singing voice from given singing data by e.g. a computer is already known, as seen in Cited Patent Publication 1.

The MIDI (musical instrument digital interface) data is representative performance data and is a de-facto standard in relevant business circles. Typically, the MIDI data is used for controlling the musical sound by controlling a digital sound source termed a MIDI sound source (sound source operating by the MIDI data, such as a computer sound source or a sound source of an electronic musical instrument). A MIDI file, such as SMF (standard MIDI file), into which can be introduced lyric data, can be used for automatically formulating a music score with the lyric.

The attempt to exploit the MIDI data as parametric representations (special data representations) of the singing voice or phoneme segments making up the singing voice has also been proposed, as seen in the Cited Patent Publication 2.

Although attempts were made in these conventional techniques to express the singing voice within the data format of the MIDI data, these attempts were made after all with the sense of controlling the musical instruments, without exploiting the lyric data inherently owned by the MIDI.

Moreover, the MIDI data, prepared for musical instruments, could not be changed to the singing voice without corrections.

The speech synthesizing software, which reads an E-mail or a home page aloud, is being put to sale by many producers, including 'Simple Speech' manufactured and sold by SONY CORPORATION. However, the manner of reading aloud is in no way different from the manner of reading an ordinary text.

A mechanical apparatus for performing movements like those of the human being, using electrical or magnetic operations, is termed a "robot". The robot started to be used extensively towards the end of the sixties. Most of the robots used were industrial robots, aimed at automating the production or performing unmanned operations in plants.

In recent years, developments of utility robots, supporting the human life as a partner to the human being, that is, supporting the human activities in various aspects in our everyday life, such as in our living environment are progressing. In distinction from the industrial robots, these utility robots have the ability of learning the methods of adapting themselves to the human being with different personalities or to the variable environments in variable aspects of the living environments of the human beings. For example, pet type robots, simulating the bodily mechanism or movements of animals, such as quadruples, e.g. dogs or cats, or so-called humanoid robots, simulating the bodily mechanism or movements of the human being, walking on two legs, are already being put to practical use.

As compared to the industrial robots, these utility robots are capable of performing variable movements, with emphasis placed on entertainment properties, and hence are also termed entertainment robots. Some of these entertainment robots operate autonomously, responsive to the information from outside or to the inner states.

The artificial intelligence (AI), used in these autonomously operating robot apparatus, artificially realizes intellectual functions, such as inference or judgment, and moreover attempts to artificially realize the functions, such as feeling or instinct. Among the expression means for the artificial intelligence to outside, including visual expression means and expression means by natural languages, there is also the speech, as one of the functions expressing the natural language.

Cited Patent Publication 1

Japanese Patent No. 3233036

Cited Patent Publication 2

Japanese Patent Application Laid-Open No. H 1-95798

The above-described conventional speech synthesis technique utilizes data of special format. Or, even if the technique utilizes MIDI data, it cannot effectively exploit lyric data embedded therein, or sing aloud the MIDI data prepared for musical instruments.

SUMMARY OF THE INVENTION

In view of the above-depicted status of the art, it is an object of the present invention to provide a method and an apparatus for synthesizing the singing voice in which it is possible to synthesize the singing voice through utilization of performance data, such as MIDI data.

It is another object of the present invention to provide a method and an apparatus for synthesizing the singing voice in which, in exploiting the performance data, such as MIDI data, the performance data may be used as the singing voice, and in which the music sound may also be reproduced, along with the singing voice, from the original performance data.

It is another object of the present invention to provide a program and a recording medium for having the computer perform the singing voice synthesizing function.

It is yet another object of the present invention to provide a robot apparatus capable of performing the singing voice synthesizing function.

For accomplishing the above objects, the present invention provides a method for synthesizing the singing voice comprising an analyzing step of analyzing performance data as the musical information of the pitch, duration and the lyric, a singing voice generating step of generating the singing voice based on the music information analyzed, and a music sound generating step of generating the music sound, as an accompaniment of the singing voice, based on the performance data.

The present invention also provides an apparatus for synthesizing the singing voice comprising analyzing means for analyzing performance data as the musical information of the pitch, duration and the lyric, singing voice generating means for generating the singing voice based on the music information analyzed, and music sound generating means for generating the music sound, as an accompaniment of the singing voice, based on the performance data.

With this structure of the singing voice synthesizing method and apparatus according to the present invention, it is possible to analyze the performance data to generate the singing voice information based on the lyric and the pitch, duration and the velocity of the sound obtained from the analysis to generate the singing voice based on the singing voice information. Additionally, the lyric can be sung aloud to the accompaniment by reproducing the music sound as the accompaniment for the singing voice.

The performance data is desirably that of a MIDI file, such as SMF.

The music sound generating step or means desirably mutes, that is, does not output as the musical sound, the music sound pertaining to the portion of the performance data, to which the singing voice is accorded, in order to show up the singing voice.

Alternatively, the music sound pertaining to the portion of the performance data, to which the singing voice is accorded, is reproduced with a sound volume smaller than the volume of the singing voice, in order that this performance data portion plays the role as a melody guide in e.g. karaoke performance.

The music sound generating step or means desirably mutes the music sound pertaining to the portion of the performance data of the MIDI file corresponding to a track specified in advance as being a track to which the lyric is accorded.

There is also desirably provided a mixing step or means for synchronizing and mixing together the singing voice and the music sound. In mixing, the waveform data of the singing voice and the music sound are formulated in advance and overlaid together for mixing and the results of the mixing are stored.

The program according to the present invention allows a computer to execute the singing voice synthesizing function of the present invention. The recording medium according to the present invention may be read by a computer having the program recorded therein.

The present invention also provides an autonomous robot apparatus for performing movements based on the input information supplied thereto, comprising analyzing means for analyzing performance data as the musical information of the pitch, duration and the lyric, singing voice generating means for generating the singing voice based on the music information analyzed, and music sound generating means for generating the music sound, as an accompaniment of the singing voice, based on the performance data. This appreciably improves entertainment properties inherent in the robot apparatus.

With the method and apparatus for synthesizing the singing voice, according to the present invention, in which performance data is analyzed as the musical information of the sound pitch, sound duration and the lyric, the singing voice is generated based on the music information analyzed, and in which the music sound as the accompaniment for the singing voice is generated based on the performance data, not only the music sound is reproduced from performance data as typified by the MIDI data, (music instrument control data) but also the lyric may be sung aloud with the music sound as the accompaniment. Hence, the singing voice may be synthesized, without adding any special information, in music formulation or reproduction in which the expression in the conventional practice is solely with the sound by the musical instruments, so that music expressions may be improved appreciably.

The program according to the present invention allows the computer to execute the singing voice synthesizing function of the present invention by a computer, while the recording medium according to the present invention may be read by a computer having the program loaded thereon.

With the program and the recording medium according to the present invention, in which performance data is analyzed as the musical information of the sound pitch, sound duration and the lyric, the singing voice is generated, based on the music information analyzed, and in which the music sound as the accompaniment of the singing voice is generated, based on the performance data, not only the music sound may be reproduced from the performance data (music instrument control data) but also the singing may be made with the music sound as the accompaniment.

The robot apparatus according to the present invention achieves the singing voice synthesizing function of the present invention. The robot apparatus of the present invention is an autonomous robot apparatus performing movements based on the input information, supplied thereto, in which input performance data is analyzed as the music information of the sound pitch, sound duration and the lyric, the singing voice is generated based on the music information analyzed, and in which the music sound as the accompaniment for the singing voice is generated, based on the performance data. Hence, it is possible not only to reproduce the music sound from the performance data typified by MIDI (music instrument control data) but also to sing the lyric aloud with the music sound as the accompaniment. The result is that the ability of expressions and entertainment properties of the robot apparatus may be improved, while the relationship of the robot apparatus with the human being may become more amicable.

BRIEF DESCRIPTION OF THE DRAWINGS

FIG. 2 shows an example of the music score information of the results of analysis.

FIG. 3 shows an example of the singing voice information.

DESCRIPTION OF PREFERRED EMBODIMENTS

Figure 1:
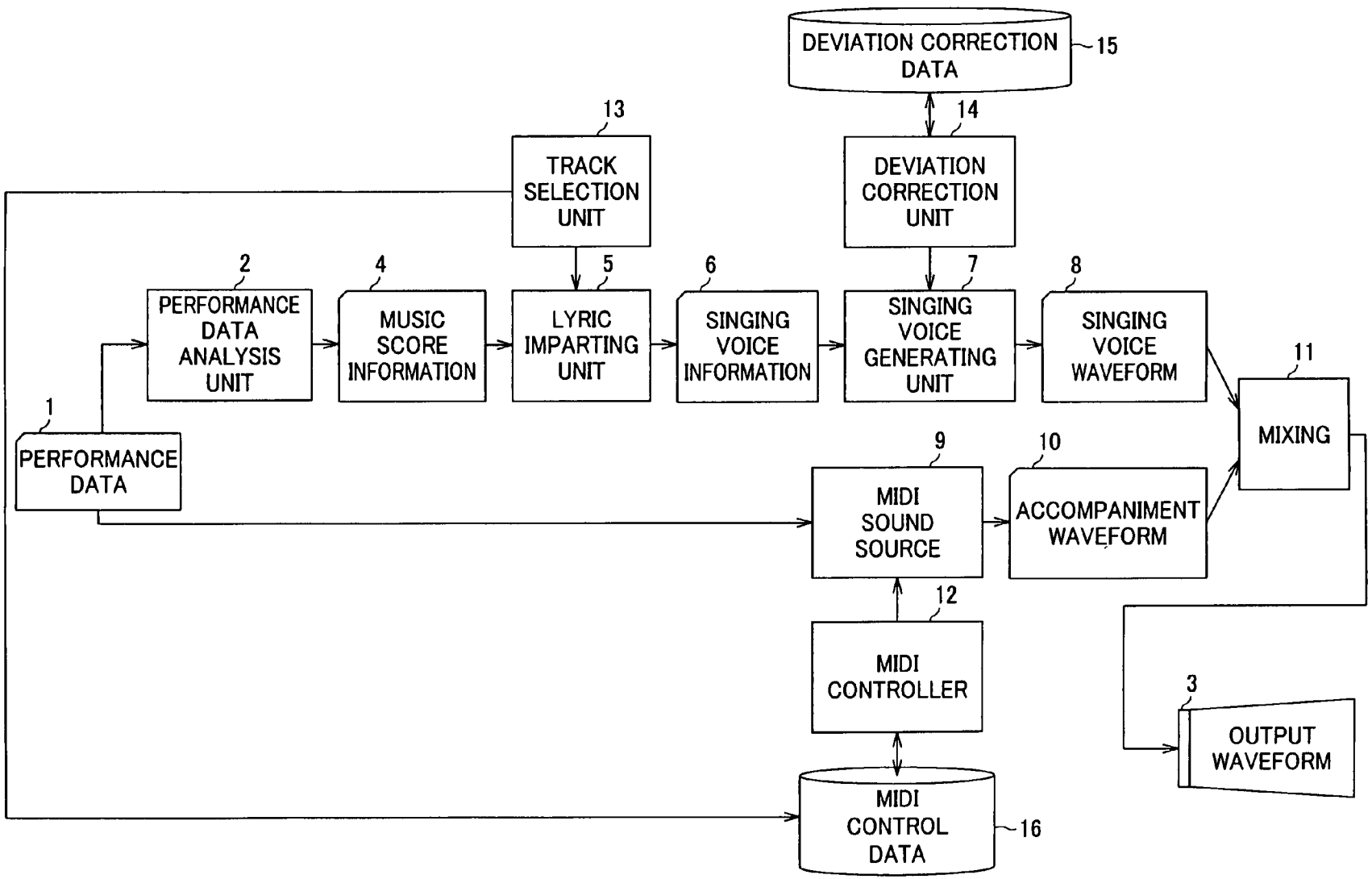
FIG. 1 is a block diagram for illustrating the system structure of a singing voice synthesizing apparatus embodying the present invention.

Referring to the drawings, specified embodiments of the present invention are now explained in detail.

FIG. 1 shows a schematic system structure of a singing voice synthesizing apparatus embodying the present invention. It should be noted that, although the singing voice synthesizing apparatus is presumed to be applied to for example a robot apparatus having at least a feeling model, a voice synthesis means and an uttering means, the singing voice synthesizing apparatus is not restricted thereto and may naturally be applicable to a variety of robot apparatus and a variety of computer AI (artificial intelligence).

In FIG. 1, a performance data analysis unit 2, configured for analyzing performance data 1, typified by the MIDI data, analyzes the input performance data 1 to convert the data into the music score information 4 representing the pitch, duration and the velocity of tracks or channels present in the performance data.

FIG. 2 shows examples of the performance data as converted to the music score information 4. In FIG. 2, events are written with respect to each track and each channel. An event may be classified into a note event and a control event. The note event has the information of the time of occurrence (column 'time' in the drawing), pitch, duration and velocity. Hence, a string of notes or a string of sounds may be defined by a sequence of the note events. The control event has the information of the time point of occurrence, control type data (such as vibrato, performance dynamics expression) and data indicating the control contents. For example, in the case of the vibrato, the control contents include items of the 'depth' specifying the magnitude of the sound swing, the 'width' specifying the period of the sound shakiness, and the 'lag' specifying the start timing of the sound shakiness (time delay as from the uttering timing). The control event for the specified track or channel is applied to reproduction of the music sound of the track or channel in question unless a new control event (control change) for the control type occurs. In addition, the lyric may be entered on the track basis in the performance data of the MIDI file. In FIG. 2, 'あるうひあるら' ('one day', uttered as a-ru-u-hi'), shown in an upper portion, is part of the lyric entered in the track 1, while 'あるうひあるら' shown in a lower portion is part of the lyric entered in the track 2. That is, the example shown in FIG. 2, is one in which the lyric has been embedded in the analyzed music information (music score information).

Meanwhile, in FIG. 2, the time is represented by 'bar: beat: number of ticks', the duration is represented by 'the number of ticks' and the velocity is represented by numerical figures of '0 to 127'. As for the pitch, 440 Hz is represented by 'A4' and, as for the vibrato, the depth, width and the lag are represented by the numerical figures of '0-64-127'.

Returning to FIG. 1, the converted music score information 4 is delivered to a lyric imparting unit 5. The lyric imparting unit 5 generates, along with the information on e.g. the duration, pitch, velocity or expression of the sound, corresponding to the notes, the singing voice information 6, provided with the lyric for the sound, based on the music score information 4.

FIG. 3 shows an example of the singing voice information 6. In FIG. 3, '¥song¥' is a tag indicating the start of the lyric information. A tag '¥PP, T10673075¥' indicates the pause of 10673075 μsec, a tag '¥tdyna 110 649075¥' indicates the overall velocity of 10673075 μsec as from the leading end, a tag '¥fine-100¥' indicates fine adjustment of the pitch equivalent to the fine tune of MIDI, and tags '¥vibrato NRPN_dep=64¥', '¥vibrato NRPN_del=50¥' and '¥vibrato NRPN_rat=64¥' denote the depth, lag and width of the vibrato, respectively. A tag '¥dyna 100¥' denotes the relative loudness of respective sounds, and a tag '¥G4, T288461¥あるうひ' denotes the lyric element 'あるうひ' (uttered as 'a') having a pitch of G4 and a duration of 288461 μsec. The singing voice information of FIG. 3 is obtained from the music score information shown in FIG. 2 (results of analysis of MIDI data).

As may be seen from comparison of FIGS. 2 and 3, the performance data for controlling the musical instruments, for example, the music note information, is sufficiently exploited in the generation of the singing voice information. For example, as regards the constituent element 'あるうひ' in the lyric part 'あるうひ あるら', the time of occurrence, duration, pitch and velocity contained in the control information or the note event information in the music score information (FIG. 2) are directly utilized in the attribute of singing other than 'あるうひ', namely the time of occurrence, duration, pitch and velocity of the sound 'あるうひ'. In the next lyric element 'あ' (uttered as 'ru'), the corresponding note event information in the same track and channel in the music score information is directly utilized, and so forth.

Returning to FIG. 1, the singing voice information 6 is delivered to a singing voice generating unit 7. This singing voice generating unit 7 forms a speech synthesizer. The singing voice generating unit 7 generates a waveform of the singing voice 8 based on the singing voice information 6. The singing voice generating unit 7, generating the waveform of the singing voice 8 from the singing voice formation 6, is formed as shown for example in FIG. 4.

Figure 4:
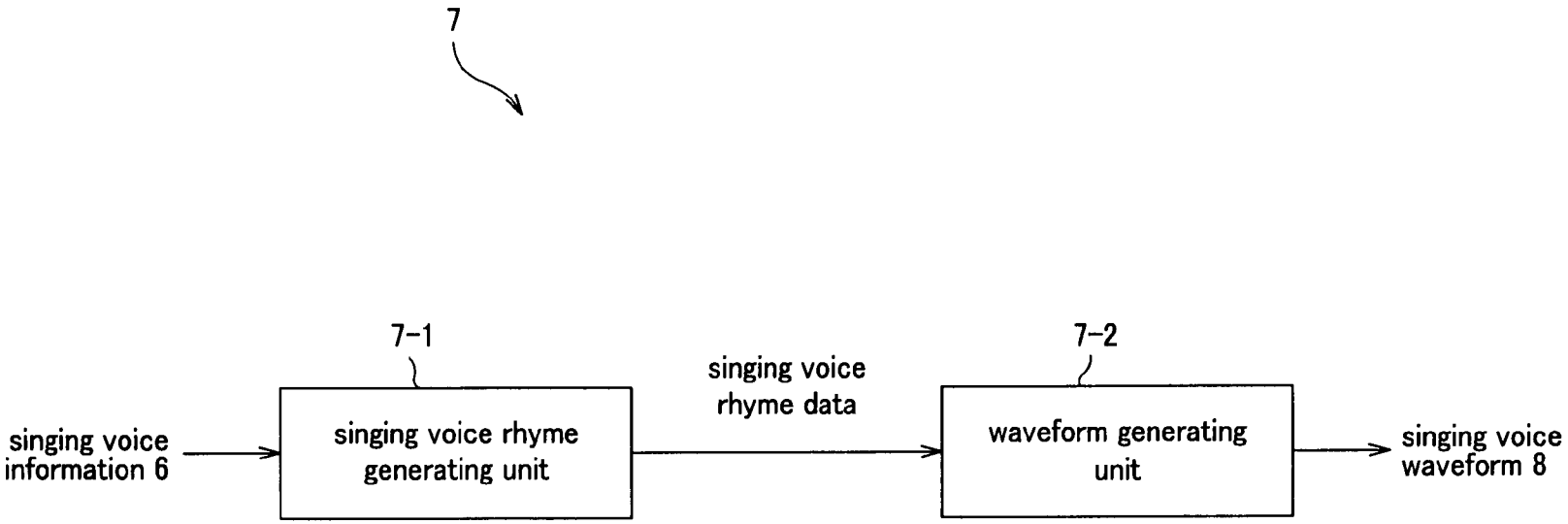
FIG. 4 is a block diagram showing an illustrative structure of a singing voice generating unit.

In FIG. 4, a singing voice rhyme generating unit 7-1 converts the singing voice information 6 into singing voice rhyme data. A waveform generating unit 7-2 converts the singing voice rhyme data into the waveform of the singing voice 8.

As a concrete example, the case in which a lyric element 'る' (uttered as 'ra') of the pitch of 'A4' is elongated a preset time length is explained. The singing voice rhyme data in case of not applying the vibrato are as shown in the following Table 1:

TABLE 1

| [LABEL] | | [PITCH] | | [VOLUME] | |
|---|---|---|---|---|---|
| 0 | ra | 0 | 50 | 0 | 66 |
| 1000 | aa | | | 39600 | 57 |
| 39600 | aa | | | 40100 | 48 |
| 40100 | aa | | | 40600 | 39 |
| 40600 | aa | | | 41100 | 30 |
| 41100 | aa | | | 41600 | 21 |
| 41600 | aa | | | 42100 | 12 |
| 42100 | aa | | | 42600 | 3 |
| 42600 | aa | | | | |
| 43100 | a. | | | | |

In the above Table, [LABEL] depicts the duration of each phoneme. That is, the phoneme 'ra' (phoneme segment) denotes the duration of 1000 samples from the sample 0 to the sample 1000, while the first phoneme 'aa' after 'ra' denotes the duration of 38600 samples from the sample 1000 to the sample 39600. The 'PITCH' denotes the pitch period by a dot pitch. That is, the pitch period at a sample 0 point is 56 samples. Since the pitch of 'る' is not changed here, the pitch period of 56 samples is applied to all samples. The 'VOLUME' denotes the relative sound volume at each sample point. That is, if the default is 100%, the sound volume at the sample 0 point is 66%, that at the sample 39600 point is 57%, that at the sample 40100 point is 48%, and so forth. The sound volume at the sample 42600 point is 3%. In this manner, attenuation of the voice 'る' with lapse of time may be achieved.

If vibrato is applied, the following singing voice rhyme data, for example, is formed.

TABLE 2

| [LABEL] | | [PITCH] | | [VOLUME] | |
|---|---|---|---|---|---|
| 0 | ra | 0 | 50 | 0 | 66 |
| 1000 | aa | 1000 | 50 | 39600 | 57 |
| 11000 | aa | 2000 | 53 | 40100 | 48 |
| 21000 | aa | 4009 | 47 | 40600 | 39 |
| 31000 | aa | 6009 | 53 | 41100 | 30 |
| 39600 | aa | 8010 | 47 | 41600 | 21 |

TABLE 2-continued

| [LABEL] | | [PITCH] | | [VOLUME] | |
|---|---|---|---|---|---|
| 40100 | aa | 10010 | 53 | 42100 | 12 |
| 40600 | aa | 12011 | 47 | 42600 | 3 |
| 41100 | aa | 14011 | 53 | | |
| 41600 | aa | 16022 | 47 | | |
| 42100 | aa | 18022 | 53 | | |
| 42600 | aa | 20031 | 47 | | |
| 43100 | a. | 22031 | 53 | | |
| | | 24042 | 47 | | |
| | | 26042 | 53 | | |
| | | 28045 | 47 | | |
| | | 30045 | 53 | | |
| | | 32051 | 47 | | |
| | | 34051 | 53 | | |
| | | 36062 | 47 | | |
| | | 38062 | 53 | | |
| | | 40074 | 47 | | |
| | | 42074 | 53 | | |
| | | 43100 | 50 | | |

As may be seen from the column [PITCH] of Table 2, the pitch period at sample 0 and sample 1000 points are the same and equal to 50 samples, such that there is no change in the voice pitch. Thereafter, the pitch period is swung up and down (50±3), with a period (width) of approximately 4000 samples, such as, for example, a 53 sample period at a sample 2000 point, a 47 sample pitch period at a sample 4009 point, a 53 sample pitch period at a sample 6009 point, and so forth. This achieves the vibrato which is the shakiness of the voice pitch. The data of the column [PITCH] is generated on the basis of the information pertinent to for example the singing voice element (for example, 'る') in the singing voice information 6, in particular the note number, such as A4, and vibrato control data, for example, a tag '¥vibrato NRPN_dep=64¥', '¥vibrato NRPN_del=50¥' and '¥vibrato NRPN_rat=64¥'.

Based on these singing voice rhyme data, the waveform generating unit 7-2 reads out corresponding samples from a data memory, not shown, having phoneme segment data stored therein, in order to generate the singing voice waveform 8. That is, the waveform generating unit 7-2 refers to the data memory and, based on the rhyme sequence, pitch period, and sound volume indicated in the singing voice rhyme data, retrieves closest phoneme segment data, to slice out and array these data, in order to generate speech waveform data. Specifically, the phoneme segment data are stored in the data memory, such as in the form of CV (consonants and vowels), VCV or CVC. Based on the singing voice rhyme data, the waveform generating unit 7-2 interconnects the needed phoneme segment data and adds pause, accents or intonation as necessary to generate the singing voice waveform 8. It should be noted that the singing voice generating unit 7 for generating the singing voice waveform 8 from the singing voice information 6 is not limited to that described above and any suitable known speech synthesizer may be used.

Returning to FIG. 1, the performance data 1 is delivered to a MIDI sound source 9, and MIDI sound source 9 then generates the music sound based on the performance data. This musical sound is an accompaniment waveform 10.

The singing voice waveform 8 and the accompaniment waveform 10 are delivered to a mixer 11 where the waveforms are synchronized and mixed to each other.

The mixer 11 synchronizes and overlays the singing voice waveform 8 and the accompaniment waveform 10 to each other and reproduces the synchronized and overlaid waveforms as an output waveform 3 to reproduce the music by the singing voice with the accompaniment, based on the performance data 1.

The reproduction of the music sound with the MIDI sound source 9 is carried out as the MIDI controller 12 applies muting or sound volume adjustment to the track or channel specified by MIDI control data 16.

In the MIDI control data 16, there is reflected the information on the track or channel as selected by a track selecting unit 13 which, in according the lyric in the lyric imparting part 5, discriminates and sets to which track should be accorded the lyric, such that, when the music data from the MIDI sound source 9 and the singing sound data generated by the singing voice generating unit 7 are reproduced simultaneously, muting or sound volume adjustment can be automatically applied to the track or channel in which the singing voice is produced.

Apart from this, muting or sound volume adjustment can be applied to an optional track or channel under instructions from the operator.

The MIDI data 16 can be saved in a manner correlated with MIDI data being played, such as by having the common filename and different extensions.

In general, the MIDI sound source 9 is able to save the music sound to be reproduced as waveform data of e.g. the wav type. In mixing the MIDI music sound data with the singing voice data, the mixer 11 is able to mix the data by overlaying the waveform data of the MIDI music sound data, provided in advance, on the waveform of the singing voice data.

In a sequencer, such as DTM (desk top music), data of the speech waveform (wav type) can routinely be handled. The waveform arranged as the speech waveform as described above can be taken in by a sequencer, as the speech waveform, such as DTM, such that the processing of mixing thereof with the MIDI music sound can be carried out by the sequencer.

In a known manner, the MIDI sound source 9 in general is subjected to deviation, if only of a small magnitude, owing to clock timing difference, in the case where the music sound reproduced is prolonged due to the particular sound source used. A deviation correction unit 14 performs correction of this deviation by multiplying a threshold value provided in advance in deviation correction data 15 in agreement with the type of the MIDI sound source 9 with timing data used in generating the singing voice in the singing voice generating unit 7.

This deviation correction data 15 is determined by the combination of the environment, such as CPU or OS (operating system), under which the singing voice generating unit 7 is in operation, and the type of the MIDI sound source 9. Additionally, the threshold value may be changed by commands from the operator.

In the foregoing explanation, the lyric is contained in the performance data. However, this is not limitative of the present invention. If no lyric is contained in the performance data, any suitable lyric part, such as 'る' (uttered as 'ra') or 'ぽん' (uttered as 'bon'), may be automatically generated or entered by an operator, and the lyric part, thus generated or entered, may be allocated to the performance data (tracks or channels), as the target of the lyric, as selected by a track selecting unit or by the lyric imparting unit.

Figure 5:
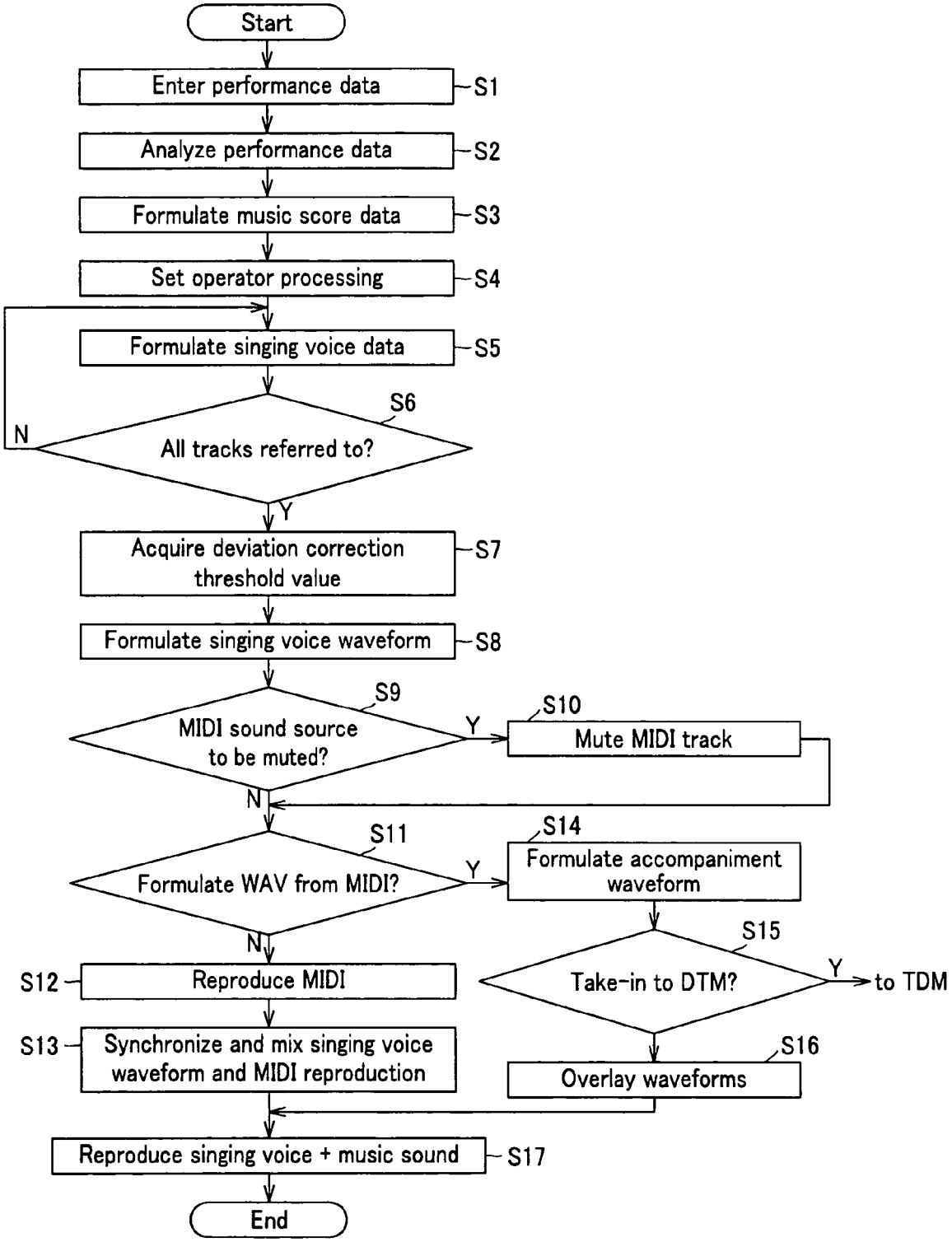
FIG. 5 is a flowchart for illustrating the operation of the singing voice synthesizing apparatus embodying the present invention.

FIG. 5 shows, as a flowchart, the overall operation of the singing voice synthesizing apparatus shown in FIG. 1.

The performance data 1 of the MIDI file is first entered (step S1). The performance data 1 is then analyzed to prepare the music score information 4 (steps S2 and S3). An inquiry is then made of an operator who then performs setting operations by the operator (such as designation of the track or channel in which the lyric appears, designation of the track or channel to which muting or sound volume adjustment needs to be applied, commands to formulate wav or to take in the waveform into the DTM, and so on) (step S4). Insofar as no setting has been made by the operator, default may be used in the subsequent processing.

The singing voice information 6 is then prepared by allocating the lyric to the performance data of the targeted track or channel, based on the formulated music score data (steps S5 and S6).

The timing deviation correction threshold value is then acquired (step S7). This threshold value is then multiplied with timing data in generating the singing voice from the singing voice information 6 in the singing voice generating unit 7 to carry out the correction to generate the voice waveform (singing voice waveform 8).

The MIDI control data 16 is then referred to in order to check whether or not there is any track or channel to be muted or any track or channel to which the sound volume adjustment is to be applied (step S9). The MIDI track or channel to be muted or adjusted for sound volume is processed accordingly (step S10). Typically, the sound volume is adjusted so that the performance data to which the lyric is accorded (MIDI track or channel) is not reproduced or is reproduced with a sound volume smaller than in the case of the singing voice.

It is then checked whether or not the wav type formulation has been commanded from the MIDI (step S11). If the wav type formulation is not commanded from MIDI, MIDI reproduction is started (step S13) so that the singing voice waveform 8 is mixed with the accompaniment waveform 10 as the two waveforms are synchronized to each other (step S17).

If the wav type formulation is commanded from MIDI, the accompaniment waveform 10 is formulated (step S14), after which it is checked whether or not the taking of the waveform into DTM has been commanded (step S15). If such taking has been commanded, the accompaniment waveform 10 is delivered to the DTM along with the singing voice waveform 8. Lacking such command, the singing voice waveform 8 is overlaid with the accompaniment waveform 10 (step S16).

After the step S13 or S16, acoustic signals, comprising the singing voice and the accompaniment, is output through a sound system, not shown, including a D/A converter, an amplifier and a loudspeaker (step S17).

Typically, the processing through steps S12, S13 to the step S17 is carried out in succession. That is, the mixing and the sound reproduction by the sound system are carried out in real-time, with the start of reproduction of MIDI as a starting sign. On the other hand, with the processing from the step S8 through the steps S14, S16 to the step S17, the waveform of the singing sound and that of the accompaniment are initially formed at the outset, overlaid together, and mixed with each other. The result is saved and the sound is reproduced responsive to the request for reproducing the sound of the music air.

The above-depicted singing noise synthesizing function is loaded on, for example, a robot apparatus 60.

The robot apparatus of the type walking on two legs, now explained as an illustrative structure, is a utility robot for supporting the human activities in various aspects of our everyday life, such as in our living environment, and is an entertainment robot capable not only of acting responsive to inner states (such as anger, sadness, happiness or pleasure) but also of representing the basic movements performed by the human beings.

Figure 6:
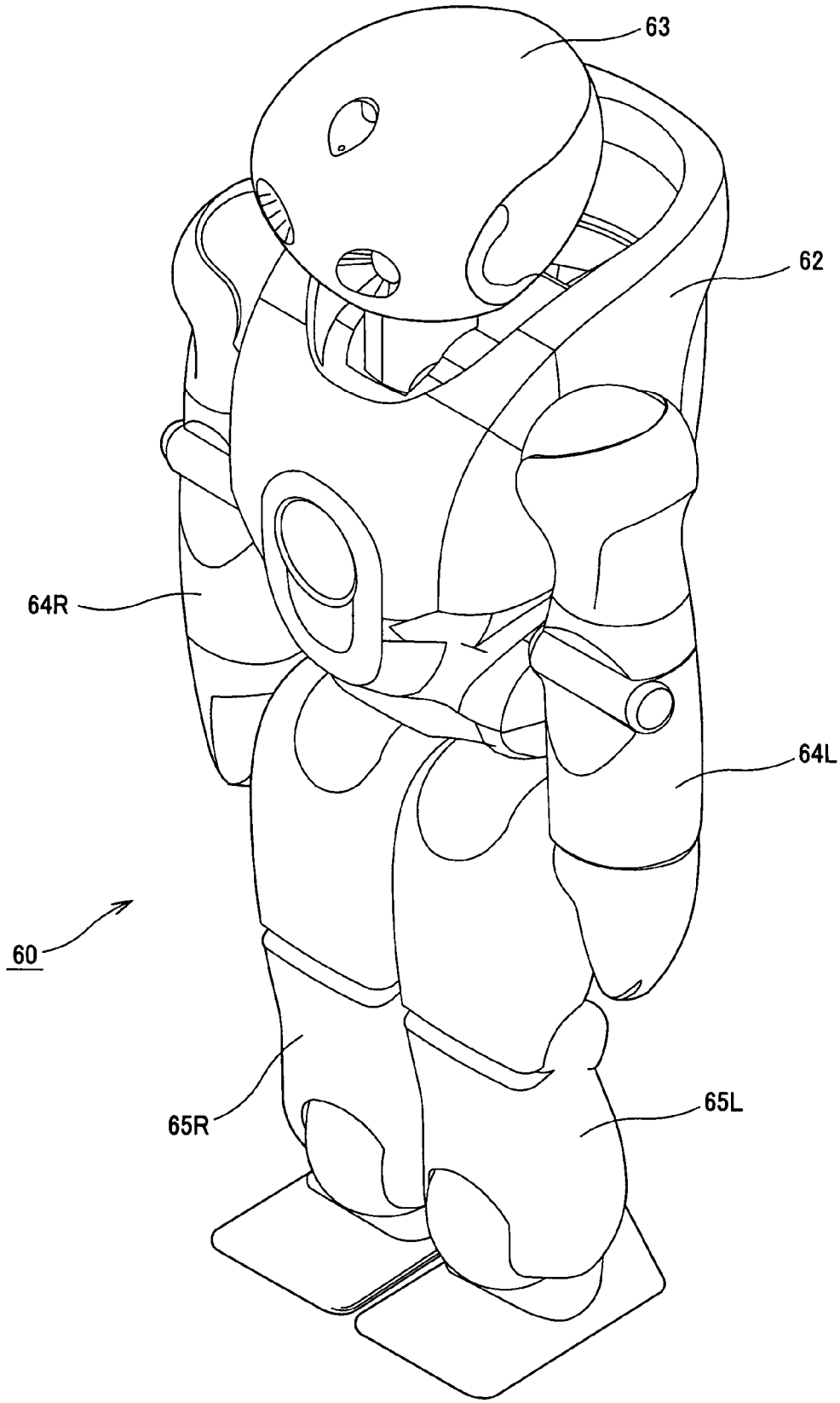
FIG. 6 is a perspective view showing the appearance of a robot apparatus embodying the present invention.

Referring to FIG. 6, the robot apparatus 60 includes a body trunk unit 62, a head unit 63, connected to preset locations of the body trunk unit 62, left and right arm units 64R/L and left and right leg units 65R/L also connected to preset locations of the body trunk unit. It should be noted that R and L are suffixes indicating right and left, respectively, as in the following.

Figure 7:
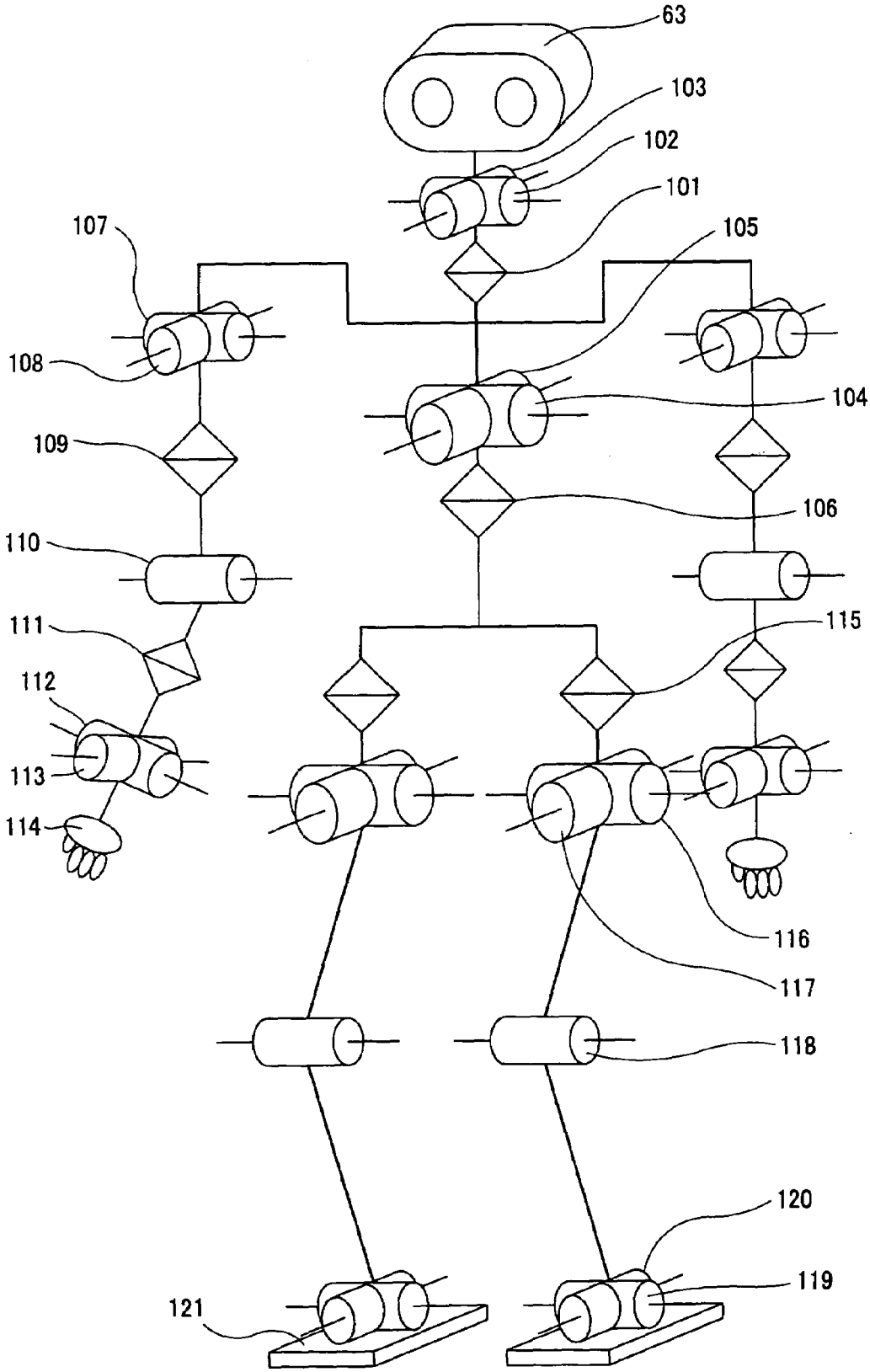
FIG. 7 schematically shows a freedom degree representing model of the robot apparatus.

FIG. 7 schematically shows the structure of the degrees of freedom provided to the robot apparatus 60. The neck joint, supporting the head unit 63, has three degrees of freedom, namely a neck joint yaw axis 101, a neck joint pitch axis 102 and a neck joint roll axis 103.

The arm units 64R/L, forming the upper limbs, are each made up by a shoulder joint pitch axis 107, a shoulder joint roll axis 108, an upper arm yaw axis 109, an elbow joint pitch axis 110, a forearm yaw axis 111, a wrist joint pitch axis 112, a wrist joint roll axis 113 and a hand part 114. The hand part 114 is, in actuality, a multi-joint multi-freedom degree structure including plural fingers. However, the hand unit 114 is assumed herein to be of zero degree of freedom because it contributes to the posture control or walking control of the robot apparatus 60 only to a lesser extent. Hence, each arm unit is assumed to have seven degrees of freedom.

The body trunk unit 62 has three degrees of freedom, namely a body trunk pitch axis 104, a body trunk roll axis 105 and a body trunk yaw axis 106.

The leg units 65R/L, forming the lower limbs, are each made up by a hip joint yaw axis 115, a hip joint pitch axis 116, a hip joint roll axis 117, a knee joint pitch axis 118, an ankle joint pitch axis 119, an ankle joint roll axis 120, and a foot unit 121. The point of intersection of the hip joint pitch axis 116 and the hip joint roll axis 117 is defined herein as the hip joint position. The foot unit 121 of the human body is, in actuality, a structure including the multi-joint multi-freedom-degree foot sole. However, the foot sole of the robot apparatus 60 is assumed to be of the zero degree of freedom. Hence, each leg part is formed by six degrees of freedom.

To summarize, the robot apparatus 60 in its entirety has $3+7\times2+3+6\times2=32$ degrees of freedom. However, the robot apparatus 60 for entertainment is not necessarily restricted to 32 degrees of freedom, such that the degrees of freedom, that is, the number of joints, may, of course, be increased or decreased depending on constraint conditions imposed by designing or manufacture or requested design parameters.

In actuality, the degrees of freedom, provided to the robot apparatus 60, are mounted using an actuator. Because of the request for eliminating excessive swell in appearance to simulate the natural body shape of the human being, and for managing posture control of an instable structure imposed by walking on two legs, the actuator is desirably small-sized and lightweight. Additionally, the actuator is desirably constructed by a small-sized AC servo actuator of the direct gear coupling type including a one-chip servo control system loaded in the motor unit.

Figure 8:
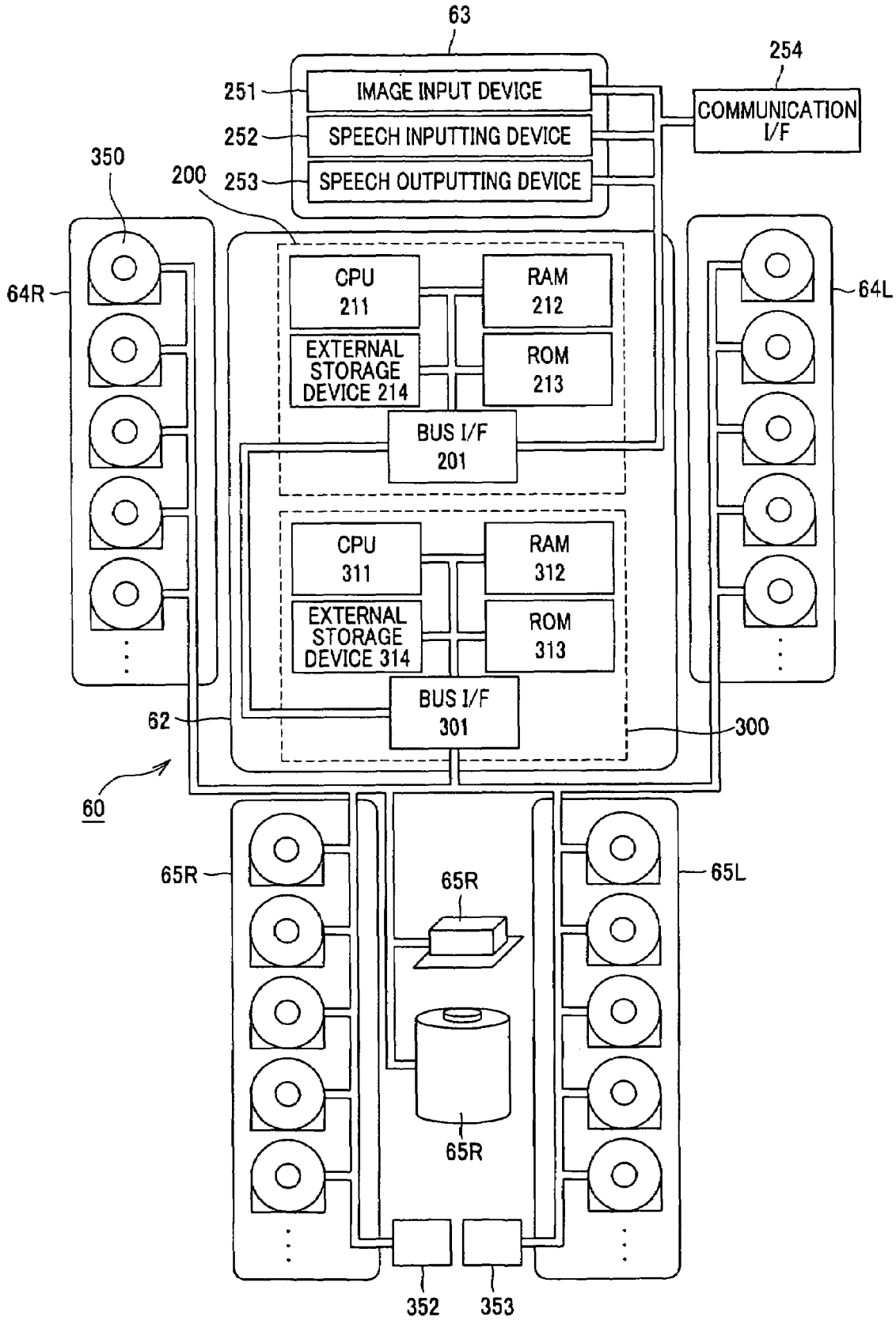
FIG. 8 is a block diagram showing the system structure of the robot apparatus.

FIG. 8 schematically shows a control system structure of the robot apparatus 60. Referring to FIG. 8, the control system is made up by a thinking control module 200 dynamically responding to e.g. a user input so as to be responsible for emotional judgment or feeling expression, and a motion control module 300 for controlling the whole-body concerted movement of the robot apparatus 60, such as the driving of an actuator 350.

The thinking control module 200, made up by a CPU (central processing unit) 211, executing calculations concerning the emotional judgment or feeling expressions, a RAM (random access memory) 212, a ROM (read-only memory) 213, and an external storage device 214, such as a hard disc drive, is an independent driven type information processing device capable of performing self-complete processing within a module.

This thinking control module 200 determines the current feeling or intention of the robot apparatus 60, responsive to stimuli from an exterior side, such as image data entered from an image inputting device 251 or speech data entered from a speech inputting device 252. The image inputting device 251 is provided with a plural number of CCD (charge-coupled device) cameras, for example, while the speech inputting device 252 is provided with a plural number of microphones.

The thinking control module 200 issues commands to the motion control module 300 to carry out a movement or a sequence of actions, which is based on the decision of the intention, that is, movements of the four limbs.

The motion control module 30, made up by a CPU 311 controlling the whole-body concerted movement of the robot apparatus 60, a RAM 312, a ROM 313, and an external storage device 314, such as a hard disc drive, is an independent driven type information processing device capable of self-complete processing within a module. The external storage device 314 is able to store a walking pattern, calculated off-line, a targeted ZMP trajectory and other action schedule. The ZMP means a point on the floor surface in which the moment by the force of reaction from the floor on which walks the robot apparatus becomes zero. The ZMP trajectory means the trajectory along which the ZMP travels during the period of walking movement of the robot apparatus 60. Meanwhile, the ZMP and use of the ZMP in the stability discrimination standard of the walking robot are explained in Miomir Vukobratovic, "Legged Locomotion Robots" (translated by Ichiro KATO et al., "Walking Robot and Artificial Leg", issued by NIKKAN KOGYO SHIMBUN-SHA.

To the motion control module 300, there are connected a variety of devices, such as the actuator 350 for realizing the degrees of freedom of the joints distributed on the whole body of the robot apparatus 60, shown in FIG. 8, a posture sensor 351 for measuring the posture or tilt of the body trunk unit 62, touchdown confirming sensors 352, 353 for detecting the left and right foot soles clearing or contacting the floor, or a power supply control device 354, supervising the power supply, such as a battery, over a bus interface (I/F) 301. The posture sensor 351 is formed e.g. by the combination of an acceleration sensor and a gyro sensor, while the touchdown confirming sensors 352, 353 are formed by proximity sensors or micro-switches.

The thinking control module 200 and the motion control module 300 are formed on a common platform and are interconnected over bus interfaces 201, 301.

The motion control module 300 controls the whole-body concerted movement by each actuator 350 for realization of the movements commanded by the thinking control module 200. That is, the CPU 311 takes out from the external ior storage device 314 the movement pattern corresponding to the action commanded by the thinking control module 200, or internally generates a movement pattern. The CPU 311 sets foot movements, ZMP trajectory, body trunk movement, upper limb movement, horizontal movement and the height of the waist part, in accordance with the designated movement pattern, while transferring command values, instructing the movement in keeping with the setting contents, to each actuator 350.

The CPU 311 also detects the posture or the tilt of the body trunk unit 62 of the robot apparatus 60, by an output signal of the posture sensor 351, while detecting whether the left and right leg units 65R/L are in the flight state or in the stance state, from the output signals of the touchdown confirming sensors 352, 353, to perform adaptive control of the whole-body concerted movement of the robot apparatus 60.

The CPU 311 controls the posture or the movement of the robot apparatus 60 so that the ZMP position is directed at all time towards the center of the ZMP stable area.

The motion control module 300 is adapted to return to the thinking control module 200 to which extent the action conforming to the intention determined by the thinking control module 200 has been realized, that is, the status of processing achieved.

In this manner, the robot apparatus 60 is able to verify the own status and the surrounding status, based on the control program, in order to act autonomously.

In the present robot apparatus 60, the program (inclusive of data), which has implemented the aforementioned singing voice synthesizing function, is placed in e.g. the ROM 213 of the thinking control module 200. In this case, the singing voice synthesizing program is run by the CPU 211 of the thinking control module 200.

By incorporating the singing voice synthesizing function in the robot apparatus, the ability of expression of a robot singing to the accompaniment is newly acquired, with the result that the entertainment properties of the robot are enhanced to provide for more intimate relationship with the human beings.

The present invention is not limited to the above-described embodiments, and may be subject to various modifications without departing from its scope.

For example, although the singing voice information, usable for the singing voice generating unit 7, corresponding to the singing voice synthesizing unit and the waveform generating unit, usable in the speech synthesizing method and apparatus as described in the specification and the drawings of the Japanese Patent Application No. 2002-73385, as previously proposed by the present Assignee, are disclosed herein, it is possible to use various other singing voice generating units. In this case, it is of course sufficient that the singing voice information, containing the information needed for generating the singing voice by a variety of singing voice generating units, is generated from the performance data. Moreover, the performance data may be any suitable data of a variety of standards, without being limited to the MIDI data.

What is claimed is:

1. A method for synthesizing a singing voice comprising:

an analyzing step of analyzing performance data as a musical information of a pitch, a duration and a lyric;

a singing voice generating step of generating the singing voice based on the music information analyzed;

a music sound generating step of generating the music sound, as an accompaniment of said singing voice, based on said performance data; and a mixing step of mixing said singing voice to the music sound as the singing voice is synchronized to the music sound, wherein the mixing step in mixing said singing voice from said singing voice generating step and said music sound from said music sound generating step formulates the waveform of the singing voice and the waveform of the music sound in advance and mixes the waveforms together, and the singing voice generating step includes correcting for a timing deviation of the music sound and singing voice based on a sound source used in said music sound generating step.

2. The method for synthesizing the singing voice according to claim 1, wherein said performance data is performance data of a MIDI file.

3. The method for synthesizing the singing voice according to claim 1, wherein said music sound generating step mutes the music sound pertaining to a portion of the performance data to which said singing voice is accorded.

4. The method for synthesizing the singing voice according to claim 2, wherein said music sound generating step mutes the music sound pertaining to a portion of the performance data for a track designated in advance.

5. The method for synthesizing the singing voice according to claim 1, wherein said music sound generating step reproduces the music sound pertaining to a portion of the performance data, to which said singing voice is accorded, with the sound volume smaller than the sound volume of said singing voice.

6. An apparatus for synthesizing the singing voice comprising:

analyzing means for analyzing performance data as the musical information of the pitch, duration and the lyric;

singing voice generating means for generating the singing voice based on the music information analyzed;

music sound generating means for generating the music sound, as an accompaniment of said singing voice, based on said performance data; and mixing means for mixing said singing voice to the music sound as the singing voice is synchronized to the music sound, and for formulating the wave form of the singing voice and the wave form of the music sound in advance and mixing the wave forms together, and for correcting for a timing deviation of the music sound and singing voice based on a sound source used in said music sound generating means.

7. The apparatus for synthesizing the singing voice according to claim 6, wherein said performance data is performance data of a MIDI file.

8. The apparatus for synthesizing the singing voice according to claim 6, wherein said music sound generating means mutes the music sound pertaining to a portion of the performance data to which said singing voice is accorded.

9. The apparatus for synthesizing the singing voice according to claim 6, wherein said music sound generating means reproduces the music sound pertaining to a portion of the performance data, to which said singing voice is accorded, with a sound volume smaller than the sound volume of said singing voice.

10. A computer-readable recording medium having recorded thereon computer readable instructions that when executed by a processor perform steps:

an analyzing step of analyzing performance data as a musical information of a pitch, a duration and a lyric;

a singing voice generating step of generating the singing voice based on the music information analyzed; and a music sound generating step of generating the music sound, as an accompaniment of said singing voice, based on said performance data; and a mixing step of mixing said singing voice to the music sound as the singing voice is synchronized to the music sound, wherein the mixing step in mixing said singing voice from said singing voice generating step and said music sound from said music sound generating step formulates the waveform of the singing voice and the waveform of the music sound in advance and mixes the waveforms together, and the singing voice generating step includes correcting for a timing deviation of the music sound and singing voice based on a sound source used in said music sound generating step.

11. The recording medium according to claim 10, wherein said performance data is performance data of a MIDI file.

12. An autonomous robot apparatus, comprising:

analyzing means for analyzing input performance data as a musical information of a pitch, a duration and a lyric;

singing voice generating means for generating the singing voice based on the music information analyzed; and music sound generating means for generating the music sound, as an accompaniment of said singing voice, based on said performance data; and mixing means for mixing said singing voice to the music sound as the singing voice is synchronized to the music sound, and for formulating the wave form of the singing voice and the wave form of the music sound in advance and mixing the wave forms together, and for correcting for a timing deviation of the music sound and singing voice based on a sound source used in said music sound generating means.

13. The autonomous robot apparatus according to claim 12, wherein said performance data is performance data of a MIDI file.

* * * * *

UNITED STATES PATENT AND TRADEMARK OFFICE

CERTIFICATE OF CORRECTION

PATENT NO. : 7,173,178 B2
APPLICATION NO. : 10/799779
DATED : February 6, 2007
INVENTOR(S) : Kenichiro Kobayashi It is certified that error appears in the above-identified patent and that said Letters Patent is hereby corrected as shown below:

Column 2, line 19, change "No. H 1-95798" to --H11-95798--.

Column 5, line 22, delete " あるう ".

Column 5, line 24, delete " あるら' " (second occurrence).

Column 5, line 53, change "T288461¥' あるうひ ' " to -- T288461¥あ' --.

Column 5, line 54, change " ' あるうひ ' " to --' あ '--.

Column 5, line 63, change " ' あるうひ ' " to --' あ '--.

Column 5, line 64, delete " あるら ' " (second occurrence).

Column 6, lines 1 & 2 change " ' あるうひ ' " to --' あ '--.

Column 6, line 3, change " ' あ ' " to --' る '--

Column 6, line 21, change " ' る ' " to --' ら '--.

Column 7, line 32, change " ' る ' " to --' ら '--.

Column 8, line 57, change " ' る ' " to --' ら '--.

Signed and Sealed this

Seventeenth Day of July, 2007

JON W. DUDAS
*Director of the United States Patent and Trademark Office*